United States Patent [19]

Dalle

[11] 3,942,948

[45] Mar. 9, 1976

[54] PROCESS FOR TREATING CELLULOSIC MATERIALS BY LIQUID AMMONIA

[75] Inventor: Jean-Paul Dalle, St. Quentin, France

[73] Assignee: Omnium de Prospective Industrielle, S.A., France

[22] Filed: Nov. 20, 1973

[21] Appl. No.: 417,641

[30] Foreign Application Priority Data

Nov. 27, 1972 France ..... 72.42165

[52] U.S. Cl. ..... 8/125; 8/149.2

[51] Int. Cl.[2] ..... D06M 1/02

[58] Field of Search ..... 8/125, 149.2

[56] References Cited

UNITED STATES PATENTS 3,406,006 10/1968 Lindberg et al. ..... 8/125

*Primary Examiner*—Carman J. Seccuro

*Attorney, Agent, or Firm*—Curtis, Morris & Safford

[57] ABSTRACT

An improved process for treating fabrics and similar cellulosic materials with liquid ammonia by conventional methods to achieve improved properties, which improvement consists of subjecting the fabric to pneumatic squeezing by means of a compressed gaseous ammonia stream.

8 Claims, No Drawings

PROCESS FOR TREATING CELLULOSIC MATERIALS BY LIQUID AMMONIA

The present invention concerns a process for the treatment with liquid ammonia of "fabrics", defined herein as including fibers, yarn, sheets, knitwear, woven material and non-woven fabrics, composed totally or in part of natural or regenerated cellulosic material.

Such treatment of cellulosic material has been known for a long time, and one knows that it improves in a considerable manner certain properties of the fabrics so treated, as for instance extensibility, resistance to shrinkage, non-iron quality, dye-affinity. It seems, however, that this treatment has not yet been applied industrially, and this for various reasons:

difficulties in handling liquid ammonia, difficulties in eliminating ammonia owing to the fact that a squeezing process operated in the conventional way is inefficient as a practical matter at the low temperatures used. It seems, moreover, that in many cases one does not even consider as necessary to squeeze the fabric which has undergone liquid ammonia treatment.

the necessity of treating and recycling ammonia to prevent the loss of important quantities of ammonia carried forward by the fabric, which requires costly installations and creates high pollution, the impossibility of obtaining a correct regulation of the process concerning the removal of ammonia molecules, not only of those which are mechanically included in the fabric but equally of those retained chemically, that is to say, those which plastify the cellulose-ammonia, and those tied to the cellulose in a covalent manner. This inconvenience is of particular importance in as much as the major part of the qualities conferred to the fabric by this treatment depend on the conditions of the elimination process.

Numerous processes for the utilization of the liquid ammonia treatment have been proposed, none of which, so far, has enabled one to resolve in a satisfactory way the above mentioned difficulties.

It is for this reason that the applicant has tried to perfect a simple and efficient process for the elimination of liquid ammonia carried by the fabric, whatever method of impregnation may have been utilized. It has become apparent that it is necessary to run this elimination process in 2 steps, the first being principally meant to remove the part of ammonia which is retained mechanically, the second to remove the ammonia which is tied chemically to the cellulose.

In accordance with the present invention, a cellulosic textile material after having undergone ammonia treatment is subsequently subjected to pneumatic squeezing, before drying, by means of a compressed gaseous ammonia flow, preferably at a pressure ranging from about 100 g to about 5 Kg per $cm^2$.

The gaseous flow has generally the boiling temperature of ammonia under the envisaged pressure conditions.

The fabric, whether presenting itself as yarn, sheet, woven material, or the like, may have been subjected to liquid ammonia by different methods: immersion in a bath, spraying, with or without application of tension. It is then impregnated with liquid ammonia in a proportion which may vary — depending on the nature of the materials and their physical and chemical properties — between 100 and 300 % in weight.

According to the proposed invention, the fabric is then subjected to pneumatic squeezing by means of a compressed gaseous ammonia flow. Depending on the nature of the fabric to be treated and the conditions to be obtained, pressure of this gas should be within 100 g and 5 $Kg/cm^2$, but should preferably be within 100 g and 3 Kg as concerns yarn, and within 100 g and 1 Kg in the case of sheet materials.

This pneumatic squeezing process may be operated by all known means, but it is particularly desirable to utilize the processes and squeezing devices as described in French patent application no. 70 02 183 and its first additional certificate no. 71 01 856 as well as French patent application no. 72 02 613 and its first additional certificate no. 72 34 900, the disclosures of which are hereby incorporated by reference. See equivalent U.S. Pat. No. 3,812,598, issued May 28, 1974, and U.S. Pat. No. 3,724,088, issued Apr. 3, 1973.

The "Apparatus for the continuous treatment of threads", as described in French patent application no. 70 02 183 and the additional certificate no. 71 01 856 are particularly well adapted for the sqeezing of fabrics in the form of threads. The damp thread is passed through a low pressure zone which is established in the supersonic flow of gaseous ammonia at the outlet of a convergent-divergent nozzle. This low pressure zone is bounded by a net-work of shock waves created at the outlet of the nozzle in the gaseous flow at supersonic speed.

The "Apparatus for the squeezing of a sheet of humid material", covered by French patent application no. 72 02 613 and its first additional certificate no. 72 34 900 is particularly well adapted for the squeezing of sheet material, of woven material and non-woven fabric. It consists essentially of a squeezing-gas-distribution-chamber bounded by a fixed element and by a mobile and deformable element in equilibrium under the pressure in this distribution chamber and an auxiliary balancing force.

The two above mentioned devices allow the squeezing of a fabric at high running speed and the regulation of this squeezing through the variation of the gaseous flow rate.

The squeezing process operated by means of the gaseous ammonia stream enables the removal of the part of liquid ammonia which is mechanically retained in the treated fabric. It allows the reduction of the amount of ammonia to between about 50 and 20% by weight, based on the weight of the yarn, and to an amount varying between about 40 and 30% in the case of sheet material.

The residual ammonia which has not been removed during the above mentioned squeezing treatment is to be eliminated according to the conventional methods; that is to say by means of vaporization, for instance with overheated vapors. It is known that vaporization is an expensive process and requires a lot of energy (heat of vaporization of liquid ammonia: 5,58 Kcal per mole), and it is therefore interesting to reduce as much as possible the amount of ammonia to be vaporized. The recovery of this small quantity of ammonia does not require much washing water, and in consequence does not produce pollution of an important degree. This quantity is so minimal and incidental that it may not even have to be taken into account.

Compared to other methods, the treatment according to the present invention brings evident advantages, either with regard to the simplification of the technology, to the savings effected in investment and running costs or with regard to the high performance of the installations and the final qualities of the fabrics so treated.

It enables the recovery of the major part of ammonia carried by the fabric and the recycling, without purification, of the fraction recovered in liquid form or, the recycling after condensation of the fraction recovered in gaseous form.

The non-pollution of the gaseous fraction by another gas, for instance by water vapor, means important savings in energy and ammonia, In fact, the presence of another gas, while reducing partial pressure in ammonia and consequently the apparent temperature of the dew-point, diminishes the efficiency of the condensation apparatus. With an amount of about 30% of other gas in the ammonia stream, the liquefaction temperature of ammonia, at air-pressure, diminishes from about − 34°C to about − 40°C, thus increasing electric consumption by about 10% and reducing the compressor capacity by about 30%. Further, the absence of another gas withdraws the danger of explosion.

The present elimination process is perfectly regular and reproducible. It is easily adaptable to all kinds of fabrics and to all techniques normally utilized, as for instance application of tension to a fabric. It allows a high speed treatment and may, in consequence, be incorporated in a production line.

The fabric so treated shows substantially improved qualities, in particular due to the fact that it has not been subjected to excessive heating. For instance, the dye-affinity exceeds by about 10% the one obtained on a fabric having undergone conventional liquid ammonia treatments.

I claim:

1. In a process for treating a fabric composed in part or totally of natural or regenerated cellulosic material by impregnation with liquid ammonia followed by removal of said ammonia from said fabric, the improvement comprising initially eliminating at least a substantial portion of said ammonia from said fabric by subjecting the fabric to pneumatic drying independent of heating by means of a compressed gaseous ammonia stream.

2. A process according to claim 1, wherein the pressure of the ammonia stream is comprised between 100 g and 5 Kg per $cm^2$.

3. A process according to claim 1, wherein the temperature of the ammonia stream is about the boiling temperature of ammonia for the given pressure conditions.

4. A process according to claim 2, wherein the temperature of the ammonia stream is about at the boiling temperature of ammonia for the given pressure conditions.

5. A process according to claim 1, wherein said fabric is passed through a drying low pressure zone bounded by a net-work of shock waves created at the outlet of a convergent-divergent nozzle established by supersonic flow of said compressed gaseous ammonia stream through said nozzle.

6. A process according to claim 1, wherein said compressed gaseous ammonia stream impinging on said fabric mechanically dislodges the impregnated liquid ammonia therefrom.

7. A process according to claim 1, wherein the residual liquid ammonia remaining after the pneumatic drying by the gaseous ammonia stream is eliminated by additional heating sufficient to cause vaporization of the residual liquid ammonia.

8. A process according to claim 7, wherein the pneumatic drying is accomplished with no additional gases contaminating the said gaseous ammonia.

* * * * *